US007632118B2

(12) United States Patent
Herlitz et al.

(10) Patent No.: US 7,632,118 B2
(45) Date of Patent: Dec. 15, 2009

(54) ADAPTER

(75) Inventors: Martin Herlitz, Remscheid (DE); Peter Paul Schekalla, Wuppertal (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/079,850

(22) Filed: Mar. 27, 2008

(65) Prior Publication Data

US 2008/0242133 A1 Oct. 2, 2008

(30) Foreign Application Priority Data

Mar. 27, 2007 (EP) ..... 07006271

(51) Int. Cl.
*H01R 29/00* (2006.01)

(52) U.S. Cl. ..... 439/166

(58) Field of Classification Search ..... 439/352, 439/357, 358, 606, 607, 610, 166, 607.01, 439/607.04, 607.05, 607.27, 607.53, 607.55
See application file for complete search history.

(56) References Cited

U.S. PATENT DOCUMENTS 6,827,610 B2 * 12/2004 Lin ..... 439/607
6,863,545 B2 * 3/2005 Peloza ..... 439/79
7,104,842 B1 * 9/2006 Huang et al. ..... 439/607
2005/0070157 A1 3/2005 Neo et al.
2006/0141865 A1 6/2006 Su et al.

FOREIGN PATENT DOCUMENTS

EP 1 589 621 10/2005

* cited by examiner

*Primary Examiner*—Edwin A. Leon
(74) *Attorney, Agent, or Firm*—Thomas N. Twomey

(57) ABSTRACT

An adapter for the coupling of two different electrical plugs, in particular for vehicles, comprises an electrically conductive cage open at two ends, in particular pin-like electrical contacts insertable into the cage with differing contact ends matched to the respective plug and in particular two differing insulation parts insertable into the cage and matched to the respective plug for the fixing of the electrical contacts. The cage, the electrical contacts and the insulation parts supporting them are designed such that different receptacle-like plug receivers matched to the respective plug result in the region of the two open ends of the cage.

17 Claims, 1 Drawing Sheet

ADAPTER

TECHNICAL FIELD

The invention relates to an adapter for the coupling of two different electrical plugs.

BACKGROUND OF THE INVENTION

Previously known adapters include, for example, a USB A inline connection in which two USB receptacles of type A are soldered next to one another on a circuit board. An adapter is also already known having a type A USB receptacle and a type B USB receptacle in which the two receptacles are again likewise arranged on a circuit board.

The "universal serial bus" (USB) is a four pin, standardized I/O bus which serves inter alia as a serial interface for computer ports. Different plugs are provided for such a USB bus in particular including a wider type A plug and a smaller, approximately square type B plug.

The known adapters have the disadvantage, among others, that they require a circuit board and are relatively complex and/or expensive both with respect to their design and with regard to their assembly.

SUMMARY OF THE INVENTION

It is the underlying object of the invention to provide an improved adapter of the initially named kind in which the aforesaid problems have been eliminated.

This object is satisfied in accordance with the invention by an adapter for the coupling of two different electrical plugs, in particular for vehicles, having an electrically conductive cage open at two ends, in particular pin-like electrical contacts insertable into the cage with differing contact ends matched to the respective plug and in particular two differing insulation parts for the fixing of the electrical contacts, wherein said insulation parts can be inserted into the cage and are matched to the respective plug, with the cage, the electrical contacts and the insulation parts supporting them being designed such that different receptacle-like plug receivers matched to the respective plug result in the region of the two open ends of the cage.

An adapter is provided on the basis of this design which is simple in structure and which can be handled without problem. The previously required circuit board is omitted. The number of individual parts as well as the assembly effort are reduced to a minimum. In addition, ideal EMV protection results due to the electrically conductive cage.

A plug receiver for a USB plug is preferably formed in the region of one of the two open ends of the electrically conductive cage.

In this connection, in accordance with a preferred practical embodiment of the adapter in accordance with the invention, a plug receiver for a type A USB plug is formed in the region of one of the two open ends of the electrically conductive cage.

It is in particular also of advantage for a plug receiver for a plug of a data transfer system, in particular a high speed data transfer system, to be formed in the region of one of the two open ends of the electrically conductive cage.

A preferred practical embodiment of the adapter in accordance with the invention is characterized in that a plug receiver for a USB plug is formed in the region of one of the two open ends of the electrically conductive cage and a plug receiver for a plug of a data transfer system, in particular a high speed data transfer system, is formed in the region of the other open end of the cage.

In this connection, the plug receiver for the USB plug is again preferably made as a plug receiver for a type A USB plug.

A respective electrical contact can therefore in particular be made as a USB spring at one end and as a pin, for example as a 0.64 mm pin, at the other end.

The electrically conductive cage is preferably made in one piece.

It is also in particular of advantage if this electrical cage is at least substantially closed except for the two open ends. Throughgoing EMV protection is thus ensured.

The electrically conductive cage is expediently formed by a sheet metal cage.

The insulation parts can in particular be made of plastic.

It is also in particular of advantage for a plurality of electrical contacts to be combined in one strip, whereby the assembly effort is further reduced.

It is also in particular of advantage for the electrical contacts each to have an at least substantially constant cross-section over their length, whereby inter alia an optimum flow of data is ensured.

The two open ends of the electrically conductive cage can be provided at mutually opposite cage sides or be offset relative to one another, for example by 90°, with the electrical contacts being correspondingly angled in the latter case.

The adapter is preferably provided with an external housing. This external housing can in particular be made from plastic. The adapter can thus be used in particular in combination with different external plastic housings at different positions, for example in a vehicle.

The invention can in particular be used in the field of shielded data connections in combination with a USB A system. A two-receptacle adapter is thus in particular conceivable, preferably for "USB A" and "automotive high speed data", having the following features:

a sheet metal cage for throughgoing EMV protection;

two plastic parts for fixing electrical contacts, for example in the form of a strip;

two-sided pins or electrical contacts which correspond to the USB A standard on the one side, for example, and are compatible in particular to a high quality vehicle data plug, on the other side.

The following advantages are obtained among others with the adapter in accordance with the invention:

omission of the circuit board and complex and/or expensive assembly processes;

optimum EMV protection;

optimum data flow due to constant cross-sections of the electrical contacts;

possible USB actual dimension matching (2.5 mm & 2 mm), for example to the standard 2.54 mm, for example by special contact part system (MTS-ST) in the plug;

parts reduction for this system.

As already mentioned, the adapter can be used with different external plastic housings at different positions, for example in a vehicle. A variant is also possible with open cage ends offset by 90° and correspondingly angled contact pins, for example 0.64 mm pins.

BRIEF DESCRIPTION OF THE DRAWINGS

The invention will be explained in more detail in the following with reference to an embodiment and to the drawing; in which are shown.

DESCRIPTION OF THE PREFERRED EMBODIMENT

Figure 1:
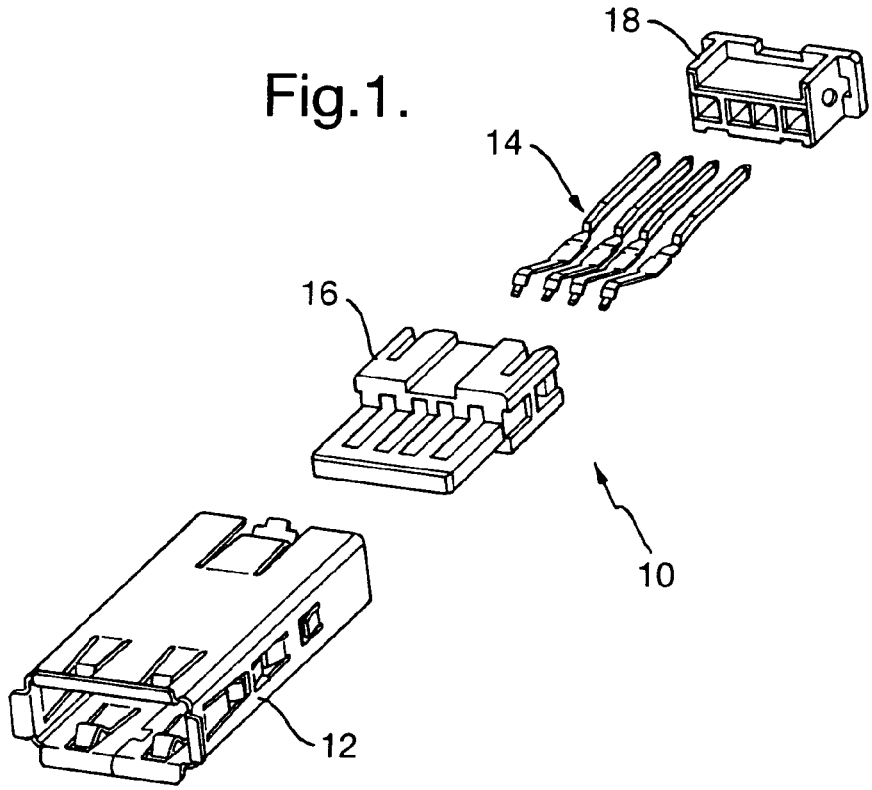
FIG. 1 is a schematic exploded representation of an exemplary embodiment of an adapter in accordance with the invention.

FIG. 1 shows, in a schematic exploded representation, an exemplary embodiment of an adapter 10 in accordance with the invention for the coupling of two different electrical plugs, which can, for example, be a USB plug, in particular of the A type, and an "automotive high speed" data plug. The adapter 10 can in particular be used in vehicles.

The adapter 10 includes an electrically conductive cage 12 open at two ends, electrical contacts 14, in particular pin-like electrical contacts insertable into the cage 12 and having differing contact ends matched to the respective plug and two differing insulation parts 16, 18 insertable into the cage 12 and matched to the respective plug for the fixing of the electrical contacts 14.

The cage 12, the electrical contacts 14 and the insulation parts 16, 18 supporting them are designed such that different receptacle-like plug receivers matched to the respective plug result in the region of the two open ends of the cage 12.

In this connection, for example, a plug receiver 20 for a USB plug, in particular a type A USB plug, is formed in the region of one of the two open ends of the electrically conductive cage 12 and a receptacle-like plug receiver for a plug of a data transfer system, in particular a high speed data transfer system ("automotive high speed data") is formed in the region of the other open end of the cage 12.

Figure 2A:
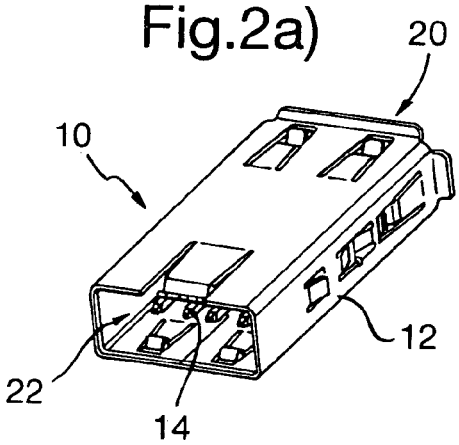
FIG. 2 is a schematic representation of the assembled adapter in accordance with FIG. 1 in two different perspective views.
Figure 2B:
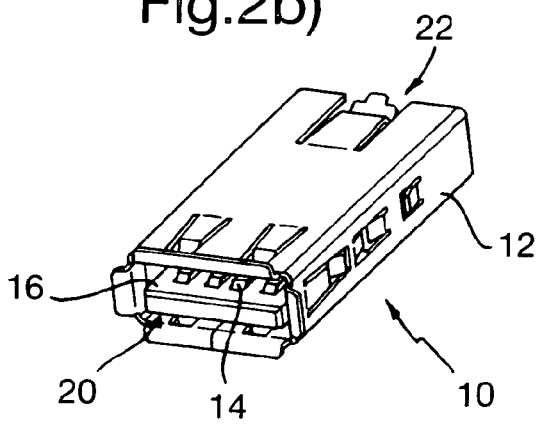

FIG. 2 shows, in a schematic representation, the assembled adapter 10 in accordance with FIG. 1 in two different perspective views. In this connection, in FIG. 2*a*), the open end of the cage 12 can be recognized in whose area the plug receiver 22 is formed for a plug of the data transfer system, in particular a high speed data transfer system. In contrast, the open end of the cage 12 can be recognized in FIG. 2*b*) in whose area the plug receiver 20 for the USB plug, in particular the type A USB plug, is formed. In this connection, the insulation part 16 is arranged in the region of the formed receptacle-like plug receiver for the USB plug and the insulation part 18 is arranged in the region of the formed plug receiver 22 for the data transfer system.

Figure 3:
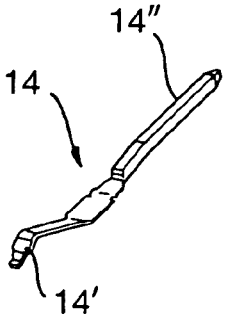
FIG. 3 is a schematic perspective representation of an electrical contact of the adapter.

FIG. 3 shows an electrical contact 14 of the adapter 10 in a schematic, perspective representation.

In this connection, in the present embodiment, the electrical contact 14 is made as a USB spring at the one end 14' and as a pin, for example a 0.64 mm pin, at the other end.

The electrically conductive cage 12 is made in one piece. It is at least substantially closed with the exception of the two open ends. In the present embodiment, it is formed by a sheet metal cage.

The two insulation parts 16, 18 can in particular be made of plastic.

It is generally also conceivable only to provide one insulation part or more than two insulation parts.

As can in particular be recognized with reference to FIG. 1, a plurality of electrical contacts 14 can be combined in a strip.

The electrical contacts 14 can each have an at least substantially constant cross-section over their length.

In the present embodiment, the two open ends of the electrically conductive cage 12 and, accordingly, the two receptacle-like plug receivers 20, 22 are provided on mutually opposite sides of the cage. However, such an embodiment is also conceivable, for example, in which the two open ends of the electrically conductive cage 12 are offset by 90° relative to one another and the electrical contacts 14 are accordingly angled by 90°.

The adapter 10 can be provided with an external housing, in particular made of plastic.

A two-receptacle adapter 10 thus results in particular for the coupling of a USB A plug with an "automotive high speed" data plug having the following features:

a sheet metal cage for throughgoing EMV protection;

two plastic parts for fixing electrical contacts, for example in the form of a strip;

two-sided pins which in particular correspond to the USB A standard from one side and are compatible with a high quality vehicle data plug, on the other side.

The previously required circuit board is omitted. The assembly is simplified overall. Optimum EMV protection results. An optimum data flow is ensured due to the preferably constant cross-sections of the electrical contacts. A USB actual size matching (2.5 mm & 2 mm) to the standard 2.54 mm is conceivable, for example, by a special contact part system ("MTS ST") in the plug. The number of the system parts is reduced to a minimum.

The adapter 10 can be used in combination with different external houses, in particular made of plastic, at different positions, for example in a vehicle.

What is claimed is:

1. An adapter for the coupling of two different electrical plugs, in particular for vehicles, having an electrically conductive cage open at two ends, pin-like electrical contacts insertable into the cage with differing contact ends, wherein each contact end is matched to one of the respective two different electrical plugs and one of two differing insulation parts, wherein each insulation part supports one of the respective different contact ends of said electrical contacts for the fixing of the electrical contacts, said insulation parts both being able to be inserted into the cage and each being matched to one of the respective two different electrical plugs, with the cage, the electrical contacts and the insulation parts supporting said electrical contacts being designed such that different receptacle-like plug receivers are each matched to the respective two different electrical plugs result in each end of the two open ends of the cage.

2. An adapter in accordance with claim 1, characterized in that one of the plug receivers is configured to match a USB plug and is formed in the region of one of the two open ends of the electrically conductive cage.

3. An adapter in accordance with claim 2, characterized in that the plug receiver configured to match a USB plug is configured to match a type A USB plug and is formed in the region of one of the two open ends of the electrically conductive cage.

4. An adapter in accordance with claim 1, characterized in that one of the plug receivers is configured to match a plug of a data transfer system, in particular a high speed data transfer system, and is formed in the region of one of the two open ends of the electrically conductive cage.

5. An adapter in accordance with claim 1, characterized in that one of the plug receivers is configured to match a USB plug and is formed in the region of one of the two open ends of the electrically conductive cage and the other of the plug receivers is configured to match a plug of a data transfer system, in particular a high speed data transfer system, and is formed in the region of the other open end of the cage.

6. An adapter in accordance with claim 5, characterized in that the plug receiver for the USB plug is made as a plug receiver for a type A USB plug.

7. An adapter in accordance with claim 1, characterized in that a respective electrical contact is made as a USB spring at one end and is made as a pin at the other end.

8. An adapter in accordance with claim 1, characterized in that the electrically conductive cage is made in one piece.

9. An adapter in accordance with claim 1, characterized in that the electrically conductive cage is at least substantially closed with the exception of the two open ends.

10. An adapter in accordance with claim 1, characterized in that the electrically conductive cage is formed by a sheet metal cage.

11. An adapter in accordance with claim 1, characterized in that the insulation parts are made of plastic.

12. An adapter in accordance with claim 1, characterized in that a plurality of electrical contacts are combined in one strip.

13. An adapter in accordance with claim 1, characterized in that the electrical contacts can each have an at least substantially constant cross-section over their length.

14. An adapter in accordance with claim 1, characterized in that the two open ends of the electrically conductive cage are provided at mutually opposite sides of the cage.

15. An adapter in accordance with claim 1, characterized in that the two open ends of the electrically conductive cage are offset by 90° relative to one another and the electrical contacts are accordingly angled by 90°.

16. An adapter in accordance with claim 1, characterized in that it is provided with an external housing.

17. An adapter in accordance with claim 16, characterized in that the external housing is made of plastic.

* * * * *